US008776812B1

(12) United States Patent
Forget

(10) Patent No.: US 8,776,812 B1
(45) Date of Patent: Jul. 15, 2014

(54) TENT WITH INSERTABLE MATTRESS

(76) Inventor: Robert J. Forget, Dunsford (CA)

( * ) Notice: Subject to any disclaimer, the term of this patent is extended or adjusted under 35 U.S.C. 154(b) by 302 days.

(21) Appl. No.: 13/039,033

(22) Filed: Mar. 2, 2011

Related U.S. Application Data

(60) Provisional application No. 61/309,462, filed on Mar. 2, 2010.

(51) Int. Cl.
*E04H 15/56* (2006.01)
*E04H 15/02* (2006.01)

(52) U.S. Cl.
USPC ..... 135/96; 135/116; 5/113; 5/414

(58) Field of Classification Search
USPC ..... 135/87, 96, 137, 116, 120.4, 905; 446/227; 5/112–113, 413 AM, 5/414–415, 417–418, 681, 690; 52/2.18, 52/2.21
See application file for complete search history.

(56) References Cited

U.S. PATENT DOCUMENTS

| | | | | |
|---|---|---|---|---|
| 1,557,382 | A * | 10/1925 | Sundback | 24/387 |
| 4,819,389 | A * | 4/1989 | Kihn | 52/2.21 |
| D330,745 | S | 11/1992 | Fogle | |
| 5,247,768 | A * | 9/1993 | Russo | 52/2.13 |
| 5,562,115 | A | 10/1996 | Sotelo | |
| 5,615,521 | A | 4/1997 | Simerka | |
| 5,632,291 | A | 5/1997 | Botbyl et al. | |
| 5,660,197 | A | 8/1997 | Boe et al. | |
| 5,699,820 | A * | 12/1997 | Evans et al. | 135/96 |
| 5,913,322 | A | 6/1999 | Gallant et al. | |
| 6,167,898 | B1 | 1/2001 | Larga et al. | |
| 6,929,016 | B2 * | 8/2005 | Lee | 135/126 |
| 7,021,694 | B1 * | 4/2006 | Roberts et al. | 296/100.18 |
| 7,047,991 | B2 * | 5/2006 | Kline | 135/96 |
| D546,914 | S | 7/2007 | Yoder | |
| 7,971,596 | B2 * | 7/2011 | Morris et al. | 135/96 |
| 2003/0106578 | A1 * | 6/2003 | Cornist | 135/137 |

FOREIGN PATENT DOCUMENTS

| | | | | |
|---|---|---|---|---|
| WO | WO 2008095295 | A1 * | 8/2008 | A47C 27/08 |

* cited by examiner

*Primary Examiner* — Winnie Yip
(74) *Attorney, Agent, or Firm* — Robert C. Montgomery; Montgomery Patent & Design

(57) ABSTRACT

A camping tent assembly having a removable inflatable mattress portion inserted into a floor portion, comprises a two-layered floor comprising a zippered edge which opens to receive the removable mattress, thereby allowing the mattress to occupy a space subjacent to the floor portion to provide a user with more interior space as compared to a conventional tent with a conventional air mattress placed above a floor portion. The mattress is inflated using a manual foot pump. The entire tent, including the deflated mattress, is simply folded or rolled up when breaking camp in much the same manner as a conventional tent. The mattress may be easily removed for repair or replacement as needed.

14 Claims, 5 Drawing Sheets

TENT WITH INSERTABLE MATTRESS

RELATED APPLICATIONS

The present invention was first described in and claims the benefit of U.S. Provisional Application No. 61/309,462 filed Mar. 2, 2010, the entire disclosures of which are incorporated herein by reference.

FIELD OF THE INVENTION

The present invention relates generally to portable tents, and in particular, to a portable tent assembly including a removable, inflatable mattress.

BACKGROUND OF THE INVENTION

Camping, hunting and other outdoor activities are among today's most popular leisure activities. While different types of camping and different types of people will have different items in their camping equipment collection, just about all of these collections will have a tent. The tent provides basic necessities of protection from the elements and a surface other than the ground upon which to sleep.

In addition to the tent, most people will utilize additional objects to provide comfort and padding while sleeping. While pillows and blankets are common, air mattresses are particularly ubiquitous for outdoors excursions due to the fact that they provide complete and portable cushioning, are relatively lightweight and compact, and can accommodate multiple persons. However, air mattresses suffer from the disadvantage that they take up a considerable amount of space inside the tent due to their height requirement. This is especially a factor in smaller tents where there is not a lot of vertical height to begin with.

Various attempts have been made to provide tents with cushioned or inflatable sleeping surfaces. Examples of these attempts can be seen by reference to several U.S. patents. U.S. Pat. No. 5,562,115, issued in the name of Sotelo, describes a combined tent and sleeping mat system including a cushioned mat along a bottom surface.

U.S. Pat. No. 5,615,521, issued in the name of Simerka, describes a tent flooring system including a support structure with two (2) separately inflatable bladder members fastenable to a bottom portion of a tent.

U.S. Pat. No. 5,632,291, issued in the name of Botbyl et al., describes a circular air mattress and tent including an air valve in a sidewall permitting pneumatic inflation of the mattress.

U.S. Pat. No. 5,660,197, issued in the name of Boe et al., describes a portable tent with an integrated inflatable mattress formed between a double cushioned floor portion of the tent.

U.S. Pat. No. 5,913,322, issued in the name of Gallant et al., describes a tent with a plurality of inflatable mattresses which can be secured to a base portion of the tent in a side-by-side orientation.

U.S. Pat. No. 6,167,898, issued in the name of Larga et al., describes a tent with an integral air mattress and a bottom surface including a series of intersecting grooves permitting air flow and water flow underneath the tent.

Additionally, ornamental designs for a tent with an inflatable floor exist, particularly U.S. Patent Nos. D 330,745 and D 546,914. However, none of these designs are similar to the present invention.

While these apparatuses fulfill their respective, particular objectives, each of these references suffer from one (1) or more of the aforementioned disadvantages. Many such apparatuses, when actuated or inflated, reduce the amount of usable space within the tent. Also, many such apparatuses are difficult to inflate. Furthermore, many such apparatuses do not enable separate use of the tent or mattress functions of the apparatus. Accordingly, there exists a need for a tent providing mattress cushioning features but without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a tent compatible with an air mattress which allows fully functional independent separate use of the tent and mattress but which does not inhibit the area within the tent during concurrent use. Thus, the object of the present invention is to solve the aforementioned disadvantages and provide for this need.

To achieve the above objectives, it is an object of the present invention to provide a tent assembly which receives an inflatable air mattress in an integral mattress cavity, thereby providing additional interior space during use as compared to simply placing an independent air mattress within a tent. The apparatus includes the tent assembly, the air mattress, and a foot pump.

Another object of the present invention is to provide standard tent features including a peaked roof, side portions a frame, and a zippered flap opening which are fully functional without the use of the air mattress. The tent further includes the mattress cavity between a first and second floor portion which provides a snug fit of the air mattress when inflated.

Yet still another object of the present invention is to provide an integral inflating means for the air mattress. The foot pump is in fluid communication with the mattress via a length of hose and enables a user to inflate the mattress by repeatedly depressing a bellow chamber with their foot.

Yet still another object of the present invention is to provide convenient storage of the foot pump when the mattress is in use inside of an integral storage pocket recessed into a top surface of the air mattress.

Yet still another object of the present invention is to provide a fastener along the open end of the mattress cavity to secure and protect the inflated mattress during use.

Yet still another object of the present invention is to maintain the full measure of utilizable interior space within the tent even after the mattress is inflated and inserted therein by causing the mattress to lift the first floor panel and effectively raise the side and top portions of the tent.

Yet still another object of the present invention is to provide a method of utilizing the device that provides a unique means of acquiring the apparatus, assembling the tent in a desired location, utilizing the tent in a normal manner, inflating the mattress with the foot pump, placing the pump within the storage pocket, inserting the mattress into the mattress cavity and thereby raising the tent, closing the mattress inside the cavity, sleeping within the tent while enjoying a cushioned bottom surface, removing, deflating, and storing the deflated mattress as desired, and being able to utilize the mattress independently of the tent if desired.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
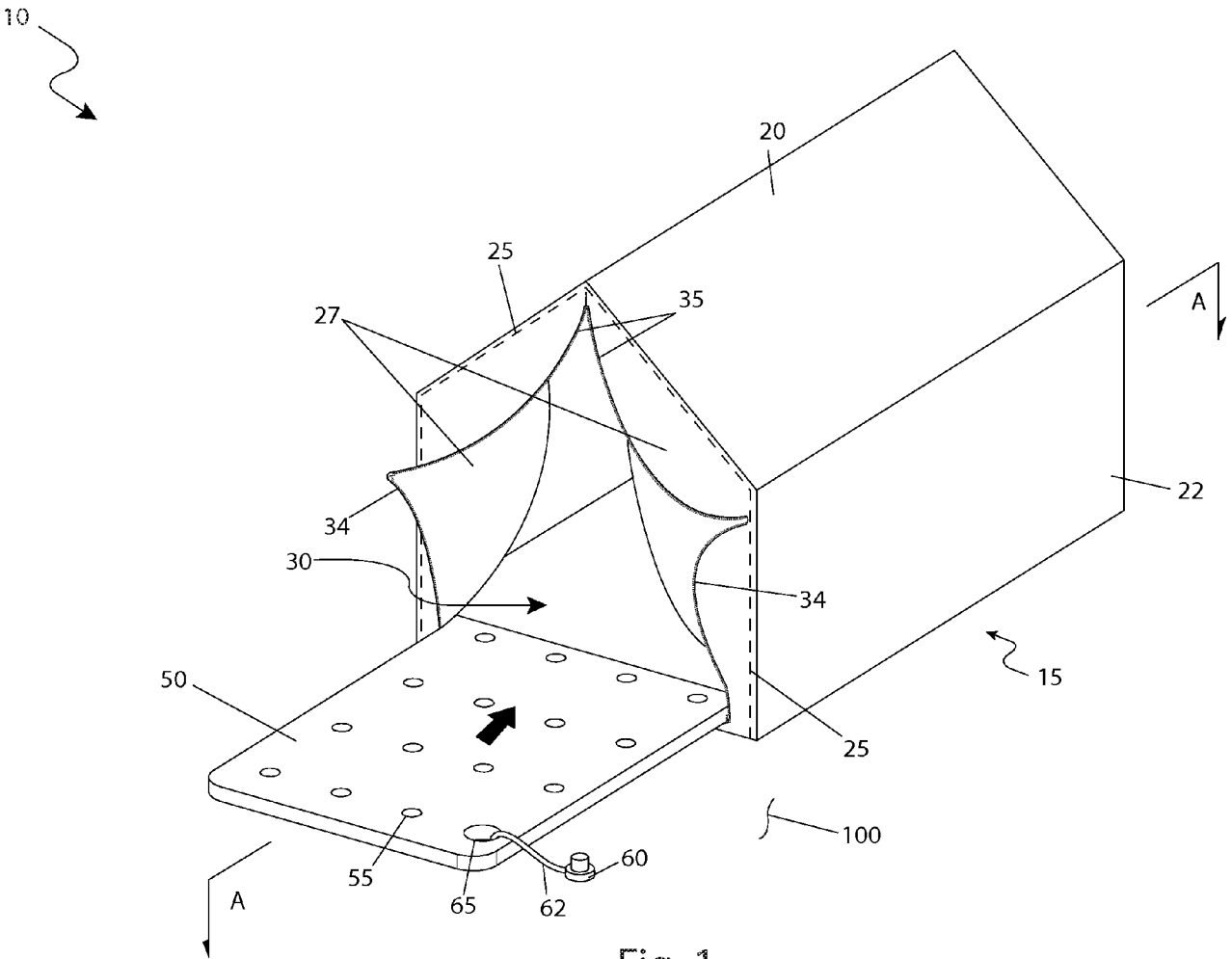
FIG. 1 is a perspective view of a tent with insertable mattress 10 depicting insertion of an air mattress portion 50, according to a preferred embodiment of the present invention.

| DESCRIPTIVE KEY | |
|---|---|
| 10 | tent with insertable mattress |
| 15 | tent assembly |
| 20 | tent roof panel |
| 22 | tent side panel |
| 23 | tent rear panel |
| 24 | tent pole foot |
| 25 | tent pole |
| 26 | tent pole connector |
| 27 | flap opening |
| 29 | mattress cavity |
| 30 | first floor panel |
| 31 | second floor panel |
| 32 | floor panel opening |
| 34 | horizontal zipper |
| 35 | vertical zipper |
| 36 | zipper puller |
| 50 | air mattress |
| 55 | vent valve |
| 60 | foot pump |
| 62 | hose |
| 65 | storage pocket |
| 100 | ground surface |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a tent with an insertable mattress (herein described as the "apparatus") 10, which provides a camping tent assembly 15 comprising a removable inflatable air mattress 50 being removably inserted into a mattress cavity 29 formed between first floor panel 30 and subjacent second floor panel 31 portions of the tent assembly 15. An open front seam of said floor panels 30, 31 receives said removable air mattress 50, thereby positioning the air mattress 50 below the tent assembly 15 to provide a user with more interior space as compared to a conventional tent which utilizes a conventional air mattress being placed within an interior space. The air mattress 50 is inflated using a common pneumatic foot pump 60. Following normal use, the air mattress 50 is deflated and the tent assembly 15 is simply folded or rolled up in a conventional manner. The air mattress 50 can be easily inserted or removed for repair or replacement by deploying a pair of horizontal zippers 34.

Referring now to FIG. 1, a perspective view of the apparatus 10 depicting insertion of an air mattress portion 50, according to the preferred embodiment of the present invention, is disclosed. The apparatus 10 comprises a camping tent assembly 15, an air mattress 50, and a foot pump 60. The camping tent assembly 15 comprises a conventional rectangular enclosure made of a plurality of textile panels assembled using conventional methods such as sewing, adhesive bonding, or the like. The tent assembly 15 is envisioned being made using conventional waterproof textile materials such as, but not limited to: polyester, polyethylene, nylon, canvas, or the like. Said tent assembly 15 comprises standard features including a peaked-roof panel 20, a pair of tent side panels 22, a rear panel 23, a tubular frame of poles 25 and connectors 26, and a pair of accessible flap opening portions 27 arranged along a front portion. Said flap openings 27 further comprise respective horizontal zippers 34, and a joining vertical zipper 35, thereby providing mechanical attachment along forwardly exposed bottom and joining edges of the flap opening 27 and the subjacent second floor panel 31 to close the tent assembly 15 while coincidentally containing the air mattress 50 within said closed tent assembly 15.

The tent poles 25 and connectors 26 are preferably fabricated from resilient, sturdy, and lightweight materials, such as metallic, plastic, or composite materials commonly associated with portable tent frame structures.

The tent assembly 15 is depicted here having a conventional rectangular "ridge-tent" design having an internal frame portion comprising a plurality of tent poles 25 tent pole connectors 26, a peak roof panel 20, and a zippered front flap opening portion 27; however, it is understood that the two-layer tent floor panels 30, 31 of the present invention 10 may be incorporated into various new tent models including tent designs such as, but not limited to: large multi-room family tents, dome tents, one-man "biker" tents, and the like. Furthermore, said tent designs are envisioned to comprise various features such as, but not limited to: other internal and external frame types, rain flies, supporting guy-wire systems, mesh windows, carrying containers, and the like, without deviating from the teaching of the invention 10 and as such should not be interpreted as a limiting factor of the apparatus 10. Furthermore, the apparatus 10 is envisioned to be provided in a variety of internal and external colors and patterns based upon a user's preference.

The tent assembly 15 comprises side 22 and rear 23 panel portions which provide permanent attachment to the tent floor portions 30, 31 being affixed along side and rear perimeter edge regions using the aforementioned textile assembly techniques. Said first 30 and second 31 tent floor portions comprise parallel rectangular horizontal shapes defining a mattress cavity 29 between, being approximately six (6) to twelve (12) inches high. The aforementioned zipper portions 34 of the flap opening 27 and second floor panel 31 are sized to define a floor flap 37 for opening and closing said floor cavity 29 so as to allow sliding insertion of a dimensionally-matching air mattress 50 into said mattress cavity 29. The air mattress 50 and tent floor portions 30, 31 comprise similar length and width dimensions, thereby providing a snug fit of the air mattress 50 when inserted between said tent floor panel portions 30, 31. Said air mattress 50 and tent floor panels 30, 31 are envisioned to be introduced in a variety of standard bedding sizes such as twin, single, queen, and the like, thereby allowing use of standard bedding materials.

The mattress 50 comprises a foot pump 60 and a capped pop-out type vent valve 55 for quick deflation. The foot pump 60 is in fluid communication with the mattress 50 via a length of common rubber or plastic hose 62 and is envisioned to be of a similar construction as those commonly provided with other air mattresses having a bellows-shaped chamber, integral check valve, oval-shaped foot pad, and the like. The air mattress 50 provides a convenient storage means to the foot pump 60 and the hose 62 when not in use, via an integral storage pocket 65 recessed into a top surface of said air mattress 50 and positioned along a top corner area of said air mattress 50. The foot pump 60 is envisioned to be extracted from the storage pocket 65 and utilized upon an adjacent ground surface 100 during filling. The air mattress 50 is envisioned to be made of polyvinylchloride (PVC) plastic, vulcanized rubber covered in canvas, polyurethane, or equivalent material, and incorporating features found on popular models of air mattresses such as, but not limited to: internal baffles affixed between top and bottom surfaces to maintain a consistent thickness of the mattress 50.

Referring now to FIGS. 2*a* through 4, various views of the apparatus 10, according to the preferred embodiment of the present invention, are disclosed. In use, the air mattress 50 in an inflated state is inserted between the floor panels 30, 31, and the horizontal zipper portions 34 are closed using respective zipper puller portions 36 to contain the mattress 50. It is envisioned that the air mattress 50 be inflated to a sufficient internal pressure sufficient to cause said tent floor panels 30, 31 and included air mattress 50 to extend in a downward direction with respect to the tent assembly 15 as seen here, so as to not subtract from an interior space within said tent assembly 15.

The tent frame further comprises a plurality of a tent foot members 24 each removably attached to terminal ends of each vertical member 25 of the tent frame. The vertical members 25 and the foot members 24 of the tent frame, which provide the sturdy support for the tent assembly 15, are each routed through a tent floor opening 32 of the first floor panel 30, thereby enabling contact of the foot members 24 to a ground surface 100 through the second floor panel 31. Each tent floor opening 32 further comprises a flap 38 located at a perimeter interior edge of the first floor panel 30 adjacent to the side panels 22 and the rear panel 23. This enables the mattress 50 to be conveniently inserted through the cavity 29 without interference with each vertical leg member 25 and foot member 26 of the tent frame.

It is envisioned that other styles and configurations of the present invention can be easily incorporated into the teachings of the present invention, and only one particular configuration shall be shown and described for purposes of clarity and disclosure and not by way of limitation of scope.

Figure 2A:
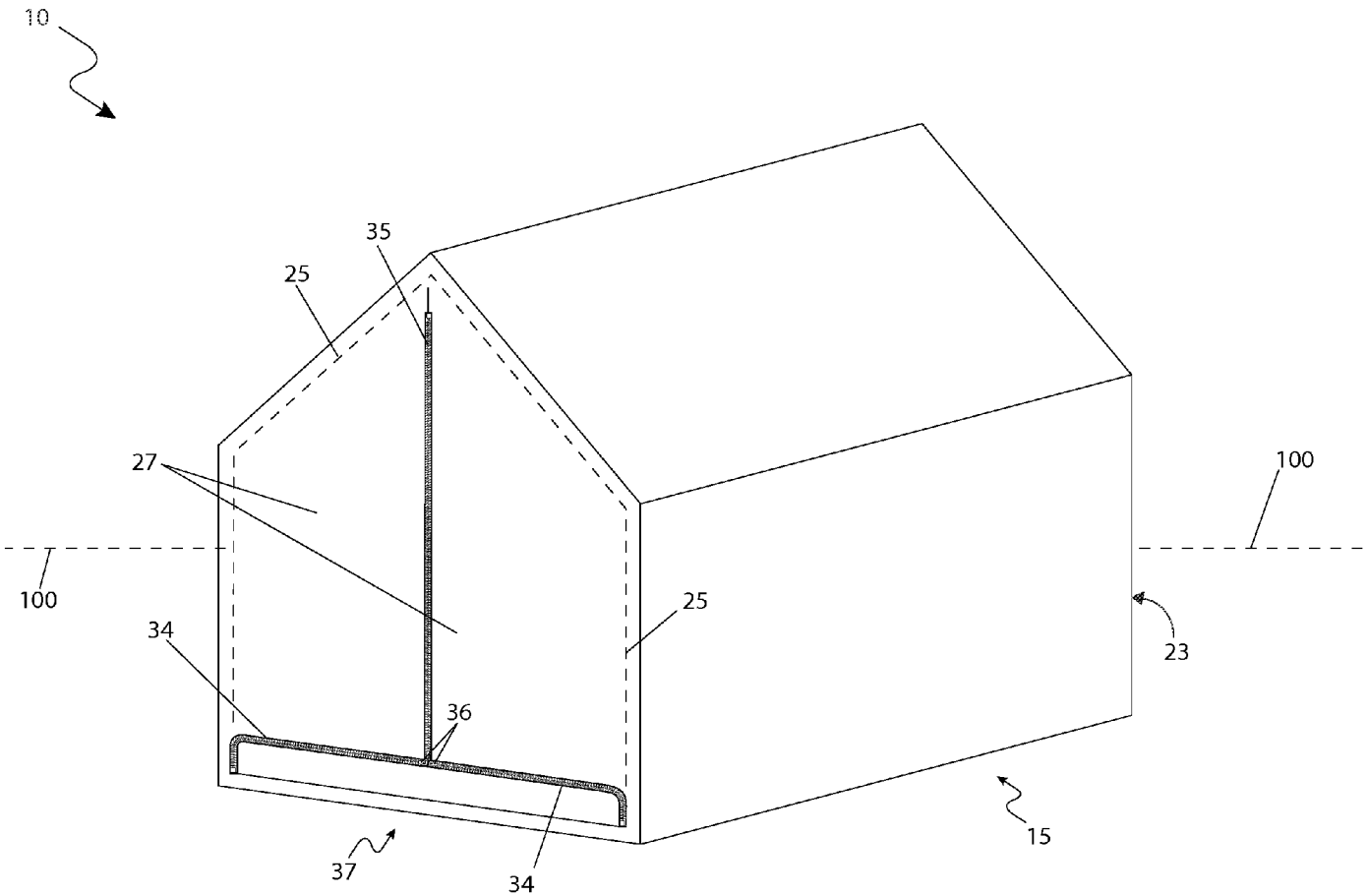
FIG. 2*a* is a perspective view of the tent with insertable mattress 10 depicting an in-use state, according to a preferred embodiment of the present invention.
Figure 2B:
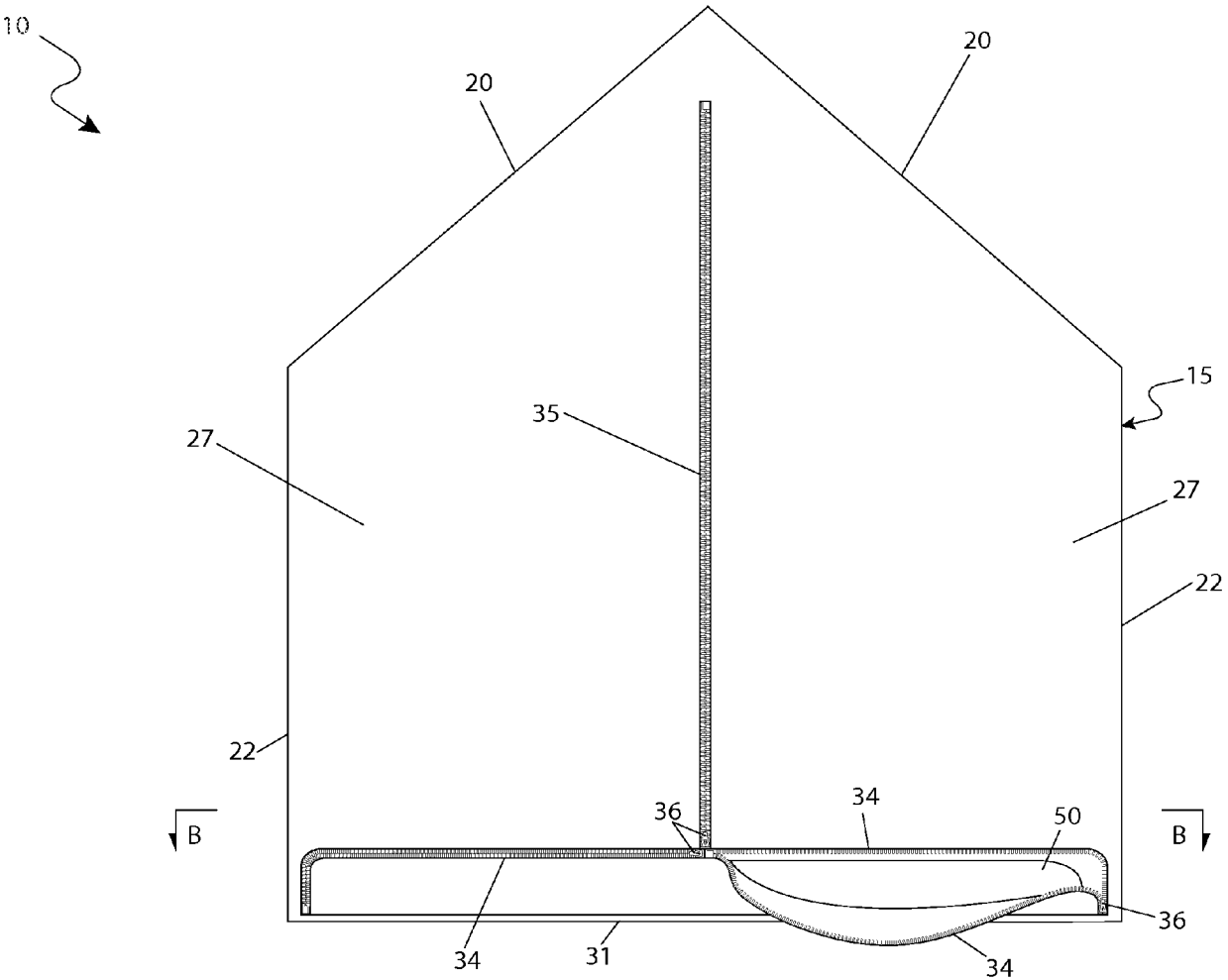
FIG. 2*b* is a front view of the tent with insertable mattress 10, according to a preferred embodiment of the present invention.
Figure 3:
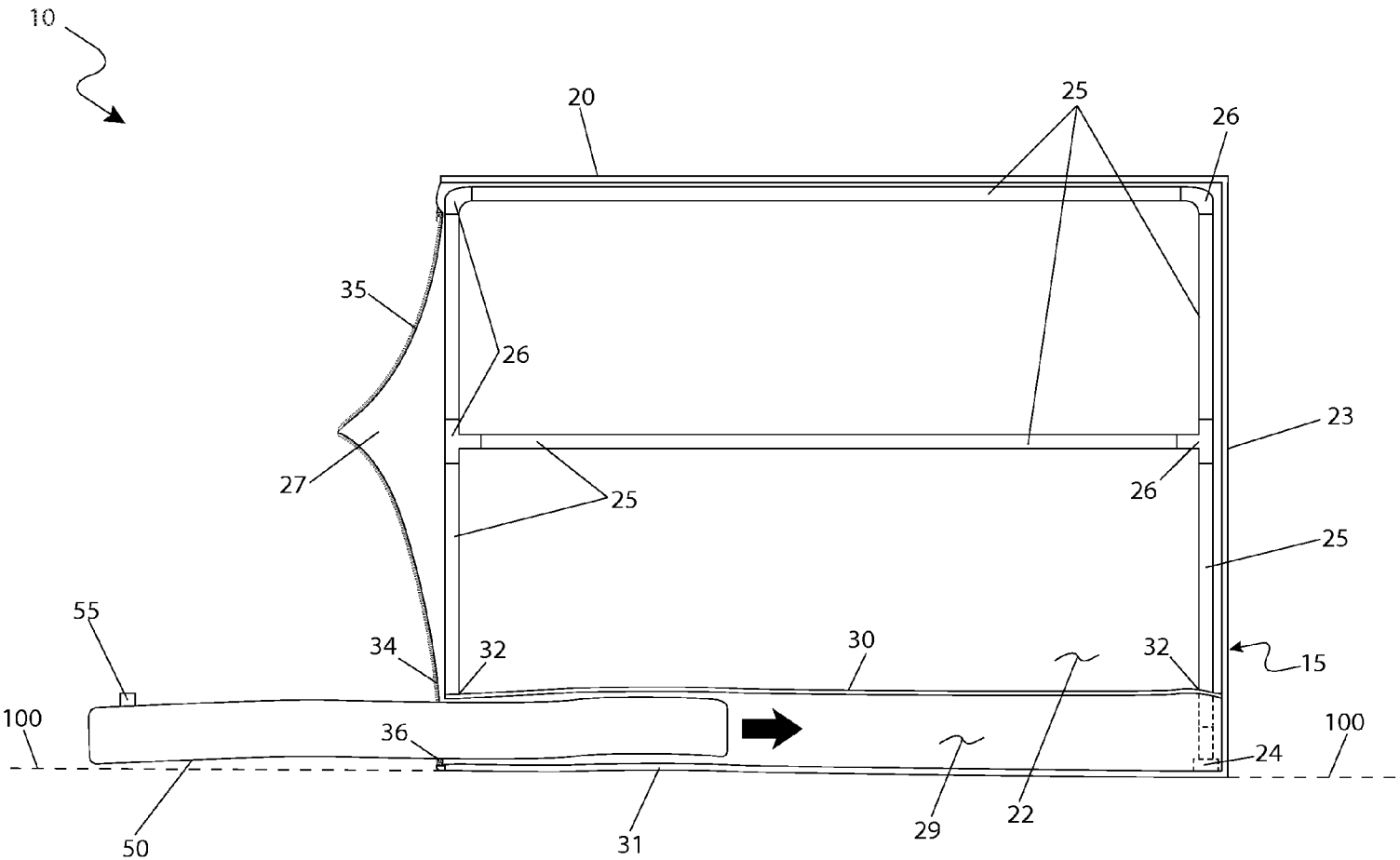
FIG. 3 is a section view of the tent with insertable mattress 10 taken along section line A-A (see FIG. 1), according to a preferred embodiment of the present invention; and, FIG. 4 is a section view of the tent with insertable mattress 10 taken along section line B-B (see FIG. 2*b*), according to a preferred embodiment of the present invention.
Figure 4:
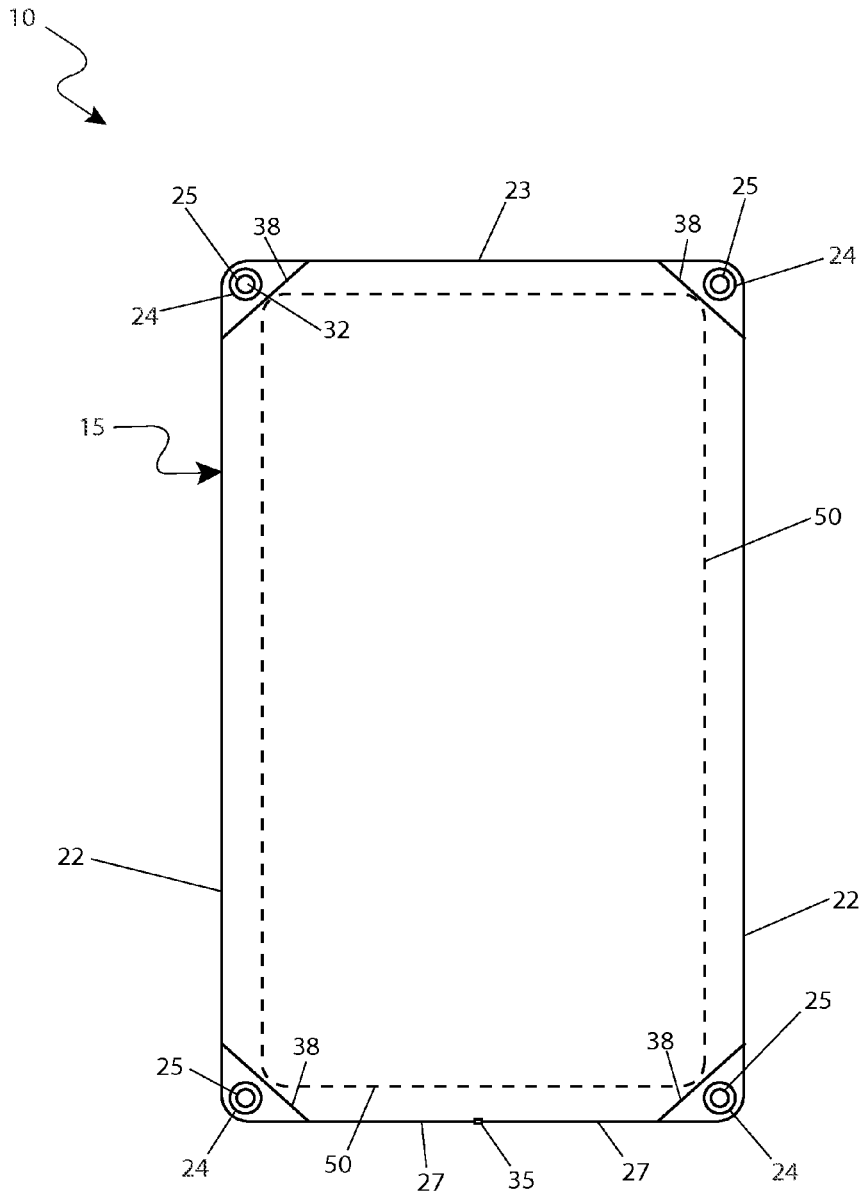

The preferred embodiment of the present invention can be utilized by the common user in a simple and effortless manner with little or no training. After initial purchase or acquisition of the apparatus 10, it would be installed as indicated in FIGS. 1 and 2.

The method of installing and utilizing the apparatus 10 may be achieved by performing the following steps: procuring a model of the apparatus 10 having desired internal and external colors and patterns and a desired size air mattress 50; selecting a suitable ground surface 100 area on which to set up the apparatus 10; unrolling and laying the apparatus 10 upon said ground surface 100; partially extracting the air mattress 50 from the mattress cavity 29 by unzipping the horizontal zippers 34 to expose the storage pocket 65 and foot pump 60; removing and placing the foot pump 60 upon the adjacent ground surface 100; inflating the air mattress 50 by pressing the foot pump 60 in an expected manner until the mattress 50 obtains a desired internal pressure; inserting the air mattress 50 completely between the floor panels 30, 31; assembling the upper portions of the tent assembly 15 by assembling the tent poles 25 and tent pole connectors 26 within the tent assembly 15; closing the zippers 34, 35; utilizing the apparatus 10 in a normal manner for camping or similar activities; and, benefiting from added comfort of an air mattress 50 within a tent assembly 15 while maintaining a maximum interior space while using the present invention 10.

During setting up of the apparatus 10, initial inflation of the air mattress 50 serves to define a firm base portion of the tent assembly 15, therefore aiding a user during assembly of the pole 25 and connector 26 portions, and the textile panel portions 20, 22, 23 of the tent assembly 15 which is especially useful in the event of a single individual setting up the apparatus 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A tent assembly, comprising:

a tent frame, comprising a plurality of interconnected tent frame members; and;

a tent body supported on said tent frame, further comprising:

a pair of side panels, a roof panel, and a rear panel affixed to each other;

a tent opening affixed to said pair of side panels opposite said rear panel, and said roof panel, enabling access to a tent interior with a removable tent opening fastener;

a floor portion, comprising:

a first floor panel affixed at a rear end to said rear panel and at a front end to said tent opening; and, a second floor panel affixed at a rear end to said rear panel and at a front end to said tent opening with a removable floor fastener, said second floor panel disposed subjacent to and spaced below said first floor panel; and, a floor cavity formed between said first floor panel and said second floor panel and accessible by said floor fastener;

wherein said floor cavity of said tent body is adapted to receive a mattress;

wherein a complete enclosure is achieved when said tent opening fastener and said floor fastener are each closed;

wherein said tent opening further comprises a pair of flaps each affixed to opposing front edges of each of said pair of side panels and said roof panel;

wherein said tent opening fastener removably fastens said pair of flaps together along a vertical seam;

wherein said floor fastener removably affixes a front edge of said second floor panel to bottom edges of each of said pair of flaps;

wherein said tent opening fastener includes:

a vertical portion defined along said vertical seam;

wherein said floor fastener includes:

a first horizontal portion beginning from a bottom-most end of said vertical portion and laterally extending away therefrom towards a first one of said side panels; and, a second horizontal portion beginning from said bottom-most end of said vertical portion and laterally extending away therefrom towards a second one of said side panels;

wherein said first and second horizontal portions travel along mutually exclusive and non-overlapping paths;

wherein each of said first and second horizontal portions have curvilinear distal ends terminating downward and subjacent to said front edge of said second floor panel to define a horizontal floor flap for opening and closing the floor cavity; and, wherein said mattress is adapted to be located in said floor cavity that is located subjacent to said bottom-most end of said vertical portion.

2. The tent assembly of claim 1, wherein said tent frame further comprises:

a plurality of tent foot portions located on bottom terminal ends of each of a plurality of leg portions;

wherein each of said plurality of tent foot portions are routed through a tent floor opening within outer perimeter edges of said first floor panel;

wherein said outer perimeter edges provide clearance for said mattress to be inserted within said floor cavity.

3. The tent assembly of claim 2, wherein said tent frame further comprises a lightweight, sturdy, and resilient material.

4. The tent assembly of claim 1, wherein said tent body further comprises a waterproof and resilient fabric.

5. The tent assembly of claim 1, wherein a height between said first floor panel and said second floor panel is approximately six inches to ten inches.

6. A tent assembly, comprising:

a tent frame, comprising a plurality of interconnected tent frame members;

a tent body supported on said tent frame, further comprising:

a pair of side panels, a roof panel, and a rear panel affixed to each other;

a tent opening affixed to said pair of side panels opposite said rear panel, and said roof panel, enabling access to a tent interior with a removable tent opening fastener;

a floor portion, comprising:

a first floor panel affixed at a rear end to said rear panel and at a front end to said tent opening; and, a second floor panel affixed at a rear end to said rear panel and at a front end to said tent opening with a removable floor fastener, said second floor panel disposed subjacent to and spaced below said first floor panel; and, a floor cavity formed between said first floor panel and said second floor panel and accessible by said floor fastener; and, a mattress;

wherein said mattress is removably inserted into said floor cavity of said tent body;

wherein a complete enclosure is achieved when said tent opening fastener and said floor fastener are each closed;

wherein said tent opening further comprises a pair of flaps each affixed to opposing front edges of each of said pair of side panels and said roof panel;

wherein said tent opening fastener removably fastens said pair of flaps together along a vertical seam;

wherein said floor fastener removably affixes a front edge of said second floor panel to bottom edges of each of said pair of flaps;

wherein said tent opening fastener includes:

a vertical portion defined along said vertical seam;

wherein said floor fastener includes:

a first horizontal portion beginning from a bottom-most end of said vertical portion and laterally extending away therefrom towards a first one of said side panels; and, a second horizontal portion beginning from said bottom-most end of said vertical portion and laterally extending away therefrom towards a second one of said side panels;

wherein said first and second horizontal portions travel along mutually exclusive and non-overlapping paths;

wherein each of said first and second horizontal portions have curvilinear distal ends terminating downward and subjacent to said front edge of said second floor panel to define a horizontal floor flap for closing and opening the floor cavity; and, wherein said mattress is adapted to be located in said floor cavity that is located subjacent to said bottom-most end of said vertical portion.

7. The tent assembly of claim 6, wherein said tent frame further comprises:

a plurality of tent foot portions located on bottom terminal ends of each of a plurality of leg portions;

wherein each of said plurality of tent foot portions are routed through a tent floor opening within outer perimeter edges of said first floor panel;

wherein said outer perimeter edges provide clearance for said mattress to be inserted within said floor cavity.

8. The tent assembly of claim 7, wherein said tent frame further comprises a lightweight, sturdy, and resilient material.

9. The tent assembly of claim 6, wherein said tent body further comprises a waterproof and resilient fabric.

10. The tent assembly of claim 6, wherein a height between said first floor panel and said second floor panel is approximately six inches to ten inches.

11. The tent assembly of claim 6, wherein said mattress further comprises an inflatable mattress bladder having a pop-out cap for removable attachment to a pressurized air source;

wherein said pop-out cap provides an inflating and a deflating means for said mattress bladder.

12. The tent assembly of claim 11, wherein said pressurized air source further comprises a foot pump having an outlet and a hose removably interconnecting said outlet to said pop-out cap.

13. The tent assembly of claim 12, wherein said mattress bladder further comprises a storage pocket recessed within a top surface thereof for removably receiving said foot pump and said hose.

14. A method for erecting and utilizing a tent assembly with a removable inflatable mattress inserted therein, comprises the following steps:

providing a tent frame assembly, further comprising a plurality of tubular frame members and interconnecting members, and a plurality of foot members;

providing a tent assembly having a tent body, further comprising:

a pair of side panels, a roof panel, and a rear panel affixed to each other;

a tent opening comprising:

a pair of flaps each affixed to opposing front edges of each of said pair of side panels and said roof panel opposite said rear panel, enabling access to a tent interior with a tent opening fastener removably fastening said pair of flaps together;

a floor portion, comprising a first floor panel affixed at a rear end to said rear panel and at a front end to said tent opening, a second floor panel affixed at a rear end to said rear panel and removably fastened at a front end to said pair of flaps with a floor fastener, said second floor panel disposed subjacent to and below said first floor panel, and a floor cavity formed between said first floor panel and said second floor panel and accessible by said floor fastener; and, a tent floor opening located at each of perimeter edges of said first floor panel adjacent to said pair of side panels and said rear panel; and, an inflatable mattress assembly, further comprising:

an inflatable mattress bladder having a pop-out cap;

a foot pump having an outlet and a hose removably interconnecting said outlet to said pop-out cap; and, a storage pocket recessed within a top surface of said mattress bladder for removably receiving said foot pump and said hose;

erecting said tent assembly by interconnecting said tent frame members within said tent body, wherein vertical members and said plurality of foot members are routed through said tent floor openings of said first floor panel to contact a ground surface through said second floor panel;

connecting said hose to said pop-out cap and said foot pump outlet;

inflating said mattress bladder with said foot pump;

inserting said inflated mattress bladder within said mattress cavity; and, securing said mattress bladder within said mattress cavity with said floor fastener.

* * * * *